US011965273B2

(12) United States Patent
Mittal et al.

(10) Patent No.: US 11,965,273 B2
(45) Date of Patent: Apr. 23, 2024

(54) TERRY TOWELS COMPRISING CORE SPUN YARNS AND ASSOCIATED METHODS FOR MANUFACTURE

(71) Applicant: Sysco Guest Supply, LLC, Somerset, NJ (US)

(72) Inventors: Khushboo Mittal, Somerset, NJ (US); Mohan Meiyappan Kandhasamy, Somerset, NJ (US)

(73) Assignee: Sysco Guest Supply, Inc., Somerset, NJ (US)

( * ) Notice: Subject to any disclaimer, the term of this patent is extended or adjusted under 35 U.S.C. 154(b) by 0 days.

(21) Appl. No.: 16/559,677

(22) Filed: Sep. 4, 2019

(65) Prior Publication Data

US 2020/0040491 A1 Feb. 6, 2020

Related U.S. Application Data

(63) Continuation of application No. PCT/US2017/024311, filed on Mar. 27, 2017.

(51) Int. Cl.

| | |
|---|---|
| ***D03D 15/00*** | (2021.01) |
| ***D03D 15/47*** | (2021.01) |
| ***D03D 27/08*** | (2006.01) |

(52) U.S. Cl.

CPC ..... *D03D 27/08* (2013.01); *D03D 15/47* (2021.01)

(58) Field of Classification Search

CPC ..... D03D 27/08; D03D 15/47; A47K 10/02

See application file for complete search history.

(56) References Cited

U.S. PATENT DOCUMENTS

| | | | | |
|---|---|---|---|---|
| 3,367,333 | A * | 2/1968 | Scheier | A61F 13/49003 604/375 |
| 3,889,028 | A * | 6/1975 | Hosterey | D04H 11/08 428/88 |
| 4,191,221 | A * | 3/1980 | Boyer | D03D 15/47 139/426 R |
| 4,352,380 | A | 10/1982 | Owen et al. | |
| 4,773,135 | A * | 9/1988 | Sato | D02G 3/38 139/397 |
| 6,666,235 | B2 | 12/2003 | Chi et al. | |
| 7,155,891 | B2 | 1/2007 | Bader | |
| 7,201,024 | B2 * | 4/2007 | Hirayama | D04B 21/12 66/192 |

(Continued)

FOREIGN PATENT DOCUMENTS

| | | |
|---|---|---|
| CN | 1532313 A | 9/2004 |
| CN | 1575359 A | 2/2005 |

(Continued)

OTHER PUBLICATIONS

International Search Report and Written Opinion for International Application No. PCT/US5017/024311, report dated Nov. 28, 2017; pp. 1-22.

(Continued)

*Primary Examiner* — Robert H Muromoto, Jr.
(74) *Attorney, Agent, or Firm* — Lowenstein Sandler LLP

(57) ABSTRACT

A terry towel including one or more layers of ground warp yarns and one or more layers of pile warp yarns interwoven with one or more layers of ground weft yarns, wherein at least one of the ground warp yarns, pile warp yarns, and ground weft yarns include one or more core spun yarns.

19 Claims, 9 Drawing Sheets

(56) References Cited

U.S. PATENT DOCUMENTS

| | | | | |
|---|---|---|---|---|
| 9,677,201 | B2 * | 6/2017 | Mandawewala | D03D 15/258 |
| 9,677,202 | B2 * | 6/2017 | Mandawewala | D02G 3/02 |
| 9,677,205 | B2 * | 6/2017 | Mandawewala | D06C 19/00 |
| 10,072,364 | B2 * | 9/2018 | Goenka | D03D 27/08 |
| 10,544,526 | B2 * | 1/2020 | Guleken | D03D 27/04 |
| 2004/0166143 | A1 * | 8/2004 | Last | C08G 63/692 424/443 |
| 2005/0031828 | A1 * | 2/2005 | Yoshida | A47L 13/256 428/92 |
| 2005/0233108 | A1 * | 10/2005 | Kurt | D04B 1/16 428/98 |
| 2006/0179810 | A1 | 8/2006 | Liao | |
| 2008/0318485 | A1 | 12/2008 | Cheng | |
| 2009/0317584 | A1 * | 12/2009 | Ivanoff | D04B 1/02 428/95 |
| 2010/0037658 | A1 * | 2/2010 | Susa | D04B 21/04 66/194 |
| 2011/0092119 | A1 | 4/2011 | Cliver et al. | |
| 2013/0040523 | A1 | 2/2013 | Masanobu et al. | |
| 2013/0101781 | A1 | 4/2013 | Lee et al. | |
| 2013/0183495 | A1 * | 7/2013 | Rock | D06M 13/192 428/156 |
| 2014/0308865 | A1 | 10/2014 | Kumar et al. | |
| 2015/0093538 | A1 * | 4/2015 | Ivanoff | D03D 27/08 428/95 |
| 2015/0167210 | A1 | 6/2015 | Tomlin | |
| 2015/0176160 | A1 | 6/2015 | Lee et al. | |
| 2016/0160406 | A1 * | 6/2016 | Agarwal | D02G 1/08 139/421 |
| 2017/0088986 | A1 * | 3/2017 | Gupta | D03D 27/08 |
| 2017/0342609 | A1 * | 11/2017 | Mandawewala | B32B 5/26 |
| 2018/0347080 | A1 * | 12/2018 | Goenka | D03D 27/08 |
| 2019/0003085 | A1 * | 1/2019 | Guleken | D03D 27/04 |
| 2019/0093264 | A1 * | 3/2019 | Erickson | D04B 15/48 |
| 2019/0194841 | A1 * | 6/2019 | Mittal | A47K 10/02 |
| 2020/0040491 | A1 * | 2/2020 | Mittal | D03D 27/08 |

FOREIGN PATENT DOCUMENTS

| | | | |
|---|---|---|---|
| CN | 1853008 | A | 10/2006 |
| CN | 102666969 | A | 9/2012 |
| CN | 203187865 | U | 9/2013 |
| CN | 203333924 | U | 12/2013 |
| CN | 103966720 | A | 8/2014 |
| CN | 203834094 | U | 9/2014 |
| CN | 104278590 | A | 1/2015 |
| CN | 105442088 | A | 3/2016 |
| DE | 102013101470 | A1 | 8/2014 |
| EP | 0385025 | B1 | 9/1990 |
| EP | 0425075 | B1 | 5/1991 |
| EP | 1302577 | B1 | 4/2003 |
| EP | 1354085 | B1 | 10/2003 |
| EP | 1542558 | B1 | 6/2005 |
| EP | 1819856 | B1 | 8/2007 |
| EP | 1846602 | B1 | 10/2007 |
| EP | 2496743 | B1 | 9/2012 |
| GB | 893766 | | 4/1962 |
| WO | 2003038169 | A1 | 5/2003 |
| WO | 2008048256 | A2 | 4/2008 |
| WO | 2014113207 | A1 | 7/2014 |
| WO | 2018182567 | A1 | 10/2018 |

OTHER PUBLICATIONS

"Thread Count Basics" available as of Dec. 6, 2017 at the website: http://www.luxuryegyptiancotton.com/resources/thread-count-basics.html; 1 page.

Extended European Search Report for European Application No. 16206469.5; Report dated Jun. 30, 2017 (pp. 1-8).

* cited by examiner

Core spun Thread

| Tex Size | T-18 | T-24 | T-30 | T-40 | T-40 | T-60 | T-80 | T-120 |
|---|---|---|---|---|---|---|---|---|
| Yarn Size | 59/2 | 45/2 | 35.2 | 29/2 | 18/2 | 15/2 | 12/2 | 18/3 |
| Av. Strength(lbs) | 2.1 | 2.7 | 3.5 | 4.5 | 7.8 | 9 | 10.6 | 13.51 |
| Elongation (% at break) | 21.5 | 20.5 | 21.5 | 21.5 | 24.2 | 24.8 | 26.3 | 25.7 |
| Shrinkage (BW) | <1% | <1% | <1% | <1% | <1% | <1% | <1% | <1% |
| Shrinkage (HA) | <3% | <3% | <3% | <3% | <3% | <3% | <3% | <3% |
| Loop Strength (lbs) | 2.7 | 4.0 | 5.2 | 6.3 | 11.6 | 13.3 | 15.8 | 20.5 |

Spun Polyester Thread

| Tex Size | T-21 | T-27 | T-40 | T-60 | T-80 | T-105 | T-120 |
|---|---|---|---|---|---|---|---|
| Yarn Size | 53/2 | 43/2 | 29/2 | 19/2 | 14/2 | 16/3 | 16/4 |
| Av. Strength(lbs) | 1.6 | 2.1 | 3.2 | 4.7 | 7.1 | 9.7 | 10.6 |
| Elongation (% at break) | 16.1 | 16.3 | 17.0 | 18.0 | 18.6 | 19.9 | 18.5 |
| Shrinkage (BW) | <1% | <1% | <1% | <1% | <1% | <1% | <1% |
| Shrinkage (HA) | <3% | <3% | <3% | <3% | <3% | <3% | <3% |
| Loop Strength (lbs) | 2.7 | 3.1 | 4.8 | 7.9 | 11.3 | 15.1 | 16.9 |

FIG. 6

| | Corespun (50/50) | Intimate Blend (50/50) | 100% Cotton |
|---|---|---|---|
| Yarn Strength (kgf) | 87 | 60.9 | 45.9 |
| Tensile Break Strength (kgf) | 59.1 | 42.3 | 29.1 |
| Tensile Break elongation (%) | 24.2 | 19.9 | 13.2 |
| Tongue Tear Strength (kgf) | 4.32 | 3.23 | 1.54 |

FIG. 7

| | Conventional Terry Towel | Terry Towel with Corespun Yarns |
|---|---|---|
| **Initial Dimension** | | |
| Initial Length (cm) | 135.7 | 131.0 |
| Initial Width (cm) | 72.4 | 63.5 |
| | | |
| **Weight/Pc-ASTM D3776** | | |
| Weight/Pc (gm) | 557.0 | 540.0 |
| | | |
| **Dimensional Stability-AATCC 135/150** | | |
| Length Shrinkage (%) | -6.4 | -3.1 |
| Width Shrinkage (%) | -3.1 | -1.2 |
| | | |
| **Tensile Strength-ASTM D5034** | | |
| Warp (Lbf) | 54.0 | 119.7 |
| Weft (Lbf) | 59.7 | 109.1 |

FIG. 8

TERRY TOWELS COMPRISING CORE SPUN YARNS AND ASSOCIATED METHODS FOR MANUFACTURE

PRIORITY INFORMATION

This application is a 371 National Phase application of Patent Cooperation Treaty (PCT) Application No. PCT/US2017/024311, filed Mar. 27, 2017 and titled "TERRY TOWELS COMPRISING CORE SPUN YARS AND ASSOCIATED METHOD FOR MANUFACTURE", which is hereby incorporated by reference in its entirety.

TECHNICAL FIELD

Embodiments described herein generally relate to terry towels comprising core spun yarns and associated methods for manufacturing. More specifically, example embodiments relate to terry towels used in institutional, industrial, and hospitality industries.

BACKGROUND

Conventional towels for use on or against the skin are formed from terry fabrics comprised of ground warp yarns, ground weft yarns, and pile yarns woven into a single terry fabric. Selection of yarn for such toweling products often involves a compromise between hand or "feel" and durability. For example, where the yarns are all-natural, 100% cotton, the resultant towel has a hand that is desirably comfortable and pleasing to the user. However, 100% cotton towels do not wear well nor do they readily survive the sometimes harsh laundering procedures to which they may be exposed, especially in commercial or industrial applications such as encountered in connection with hospitals, rest homes, clinics, hotels and the like. In this regard, such towels must be able to withstand several hundred institutional laundry cycles of high temperature or caustic washing, drying, and possibly even steam sterilization.

It is well known to manufacture towels in a process utilizing yarn spun from 100% cotton fibers. In manufacturing such a towel, the yarn is woven, as is well known, on a loom with the 100% cotton yarn being contained in the ground, fill, and pile yarns. In fact it is the 100% cotton aspect of the towel that makes it more "desirable" by the consumer since it is fixed in the mind of the purchaser that 100% cotton towels are more absorbent than other types of towels. However, when considering an institutional towel there are many drawbacks to providing 100% cotton spun yarns woven into towels since there are other issues which must be considered, which from an institutional standpoint creates disadvantages to the institution, for example a hotel chain. A hotel providing towels is a cost of doing business, thus any reductions in the cost of providing towels goes straight to the bottom line. However, cost reductions are not acceptable if customer satisfaction is sacrificed.

SUMMARY

Therefore, there is a need to maintain the absorbency, look, and feel of the towel, while reducing laundering and drying time and improving the strength of the towels for increased life expectancy.

The terry towels and products described in the below embodiments provide many benefits to institutional and hospitality towel users. One objective is to provide a towel that will exceed current experience and expectations by providing a towel which will both (i) significantly reduce laundering and drying time and (ii) yield longer life expectancy, even when harsh chemicals are used in the laundering process.

Further and other objects of the invention may become apparent to those skilled in the art when considering the following summary of the invention and a more detailed description of the preferred embodiments illustrated herein.

Embodiments of the disclosure can include terry towels comprising core spun yarns and associated methods for manufacturing. One example embodiment provides a terry towel which more effectively utilizes the beneficial properties of the core spun yarns as compared to conventional polyester and cotton blend towel constructions so as to provide quick dry properties. This property may be specifically important in the hospitality industry as it may result in reduced drying time and reduced energy usage.

Another example embodiment provides a terry towel or product with high temperature resistance and better dimensional stability because of 100% cotton coverage on the surface of the towel, which provides insulation to heat.

Another example embodiment provides a terry towel or product with 100% cotton coverage on the surface of the towel such that all the fibers that comes in contact with skin are cotton, giving the terry towel or product a great feel and comfort.

These and other embodiments can be accomplished by providing a unique terry towel or product construction in which the core spun yarns are located at the ground and/or surface of the towel for improved hand with the cotton sheath of the core spun yarns being on the outside surface and improved physical characteristics with synthetic filaments such as polyester fibers being located in the core of the yarns to give strength and durability to the towel.

More particularly, the terry towel or product of certain example embodiments can be formed of ground warp and/or ground filling yarns of core spun construction with each of the core spun warp and filling yarns having a core portion of multifilament polyester and a sheath portion formed of staple fibers helically wrapped about the multifilament polyester core portion to substantially surround and encase the multifilament polyester core.

This unique construction for a terry towel or product can provide a number of properties not otherwise obtainable in conventional polyester and cotton blend terry towels or products. Terry towel or product constructed in accordance with certain example embodiments can have an all staple fiber surface which provides a number of desirable aesthetic and functional properties, while the polyester core gives strength and durability to the towel.

The terry towel or product can exhibit noticeably better feel and comfort than conventional polyester and cotton blend terry towel or product. This property is largely due to the fact that the staple fiber is located at the surface of the towel, which takes advantage of the natural "bloom" or cover that the fiber develops during wet finishing. The unique structure of cotton fibers can also contribute to the enhancement of the cover factor. In this regard, cotton fibers have an irregularly shaped cross section as compared to the polyester fibers used in sheeting. The presence of these irregularly shaped fibers at the surface of the towel can enhance the cover factor of the towel. In addition, the natural twists or convolutions inherent in a cotton fiber, which may average at least 125 twists per inch, also contribute to the improved cover factor.

Terry towels or products formed of core spun yarns in accordance with certain example embodiments can have a rate of moisture absorbency that is significantly higher than that of conventional cotton and polyester blend terry towels or products. This can enable the terry towel or product to wick moisture away from the body much more rapidly, thereby providing a greatly enhanced comfort factor. This relatively higher rate of absorbency is due to the fact that the hydrophilic staple fibers are located on the surface of the towel, thus allowing better utilization of the beneficial hygroscopic properties of the staple fiber than is the case in conventional polyester and cotton blend terry towels or products where the cotton fibers are uniformly blended throughout the yarn structure, with many of the cotton fibers thus being buried within the yarns.

BRIEF DESCRIPTION OF THE DRAWINGS

All aspects and features of certain example embodiments of the present disclosure will be more apparent from the following description taken in conjunction with the accompanying drawings, in which:

FIG. 6 is a table comparing characteristics of an example core spun yarn with spun polyester thread;

FIG. 7 is a table comparing characteristics of an example core spun yarn with an intimate blend yarn, and a 100% cotton yarn;

FIG. 8 is a table comparing dimensional stability, absorbency, and tensile strength of a conventional terry towel with a terry towel comprising core spun yarns, according to one or more example embodiments.

The following description and the drawings sufficiently illustrate specific embodiments to enable those skilled in the art to practice them. Other embodiments may incorporate structural, process, and other changes. Portions and features of some embodiments may be included in, or substituted for, those of other embodiments. Details of one or more implementations are set forth in the accompanying drawings and in the description below. Further embodiments, features, and aspects will become apparent from the description, the drawings, and the claims. Embodiments set forth in the claims encompass all available equivalents of those claims.

DETAILED DESCRIPTION

Example embodiments relate to terry towels or products comprising core spun yarns and associated methods for manufacturing.

One example embodiment is a terry towel including one or more layers of ground warp yarns, one or more layers of pile warp yarns, and one or more layers of ground weft yarns interwoven with the one or more layers of ground warp yarns and pile yarns, wherein at least one of the ground warp yarns, pile warp yarns, and ground weft yarns include one or more core spun yarns.

Another example embodiment is a method for manufacturing a terry towel including providing one or more layers of ground warp yarns and one or more layers of pile warp yarns, and weaving one or more layers of ground weft yarns with the one or more layers of ground warp yarns and pile warp yarns, wherein at least one of the ground warp yarns, pile warp yarns, and ground weft yarns include one or more core spun yarns.

Figure 1:
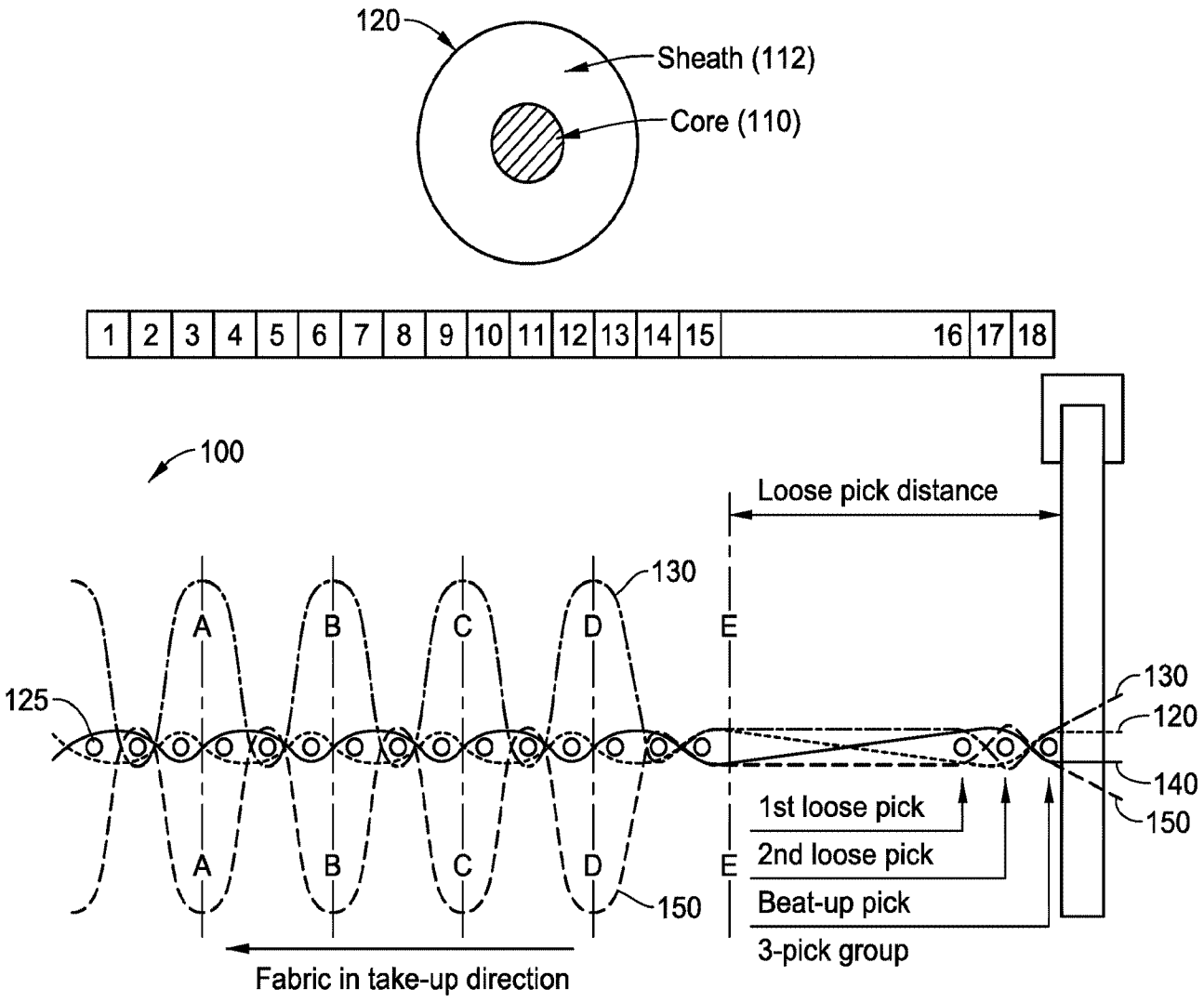
FIG. 1 is an illustrative view of a terry towel or product in accordance with one or more example embodiments.

Turning now to the figures, FIG. 1 illustrates a terry towel 100 according to one or more example embodiments of the present disclosure. Terry towel 100 may include one or more layers of ground warp yarns 120, 140, one or more layers of pile warp yarns 130, 150, and one or more layers of ground weft yarns 125, which may be interwoven with the one or more layers of ground warp yarns 120, 140 and the one or more layers of pile warp yarns 130, 150, as shown in FIG. 1. Terry towel 100 may be a single layer fabric or a multi-layer fabric including more than one layer of warp and weft yarns. As illustrated in FIG. 1, an example manner in which core spun weft and warp yarns may be interwoven, at least one of the one or more layers of ground warp yarns 120, 140, the one or more layers of pile warp yarns 130, 150, and one or more layers of ground weft yarns 125 may include one or more core spun yarns. For example, core spun yarns 120 may be in the ground warp direction or ground weft direction, or in both ground warp and ground weft directions. Alternatively, or in addition, the core spun yarns may be in the pile warp direction. In one example embodiment the pile warp yarns may be looped or sheared.

In one example embodiment, terry towel 100 may include ground weft yarns 125, which may be natural or synthetic fiber yarns, such as for example, cotton or polyester. The warp yarns, the weft yarns, or the core spun yarns may have a yarn density of about 8 to 60 Ne. The warp yarns, the weft yarns, or the core spun yarns may include single or multiple ply yarns.

As illustrated in FIG. 1, core spun yarns 120 may include a core 110 and a sheath 112 that may partially or entirely cover the core portion 110. Terry towel 100 may be exposed to temperatures as high as 300° F. or even higher during drying, and during this process, a high melting point sheath 112 may protect the low melting point core 110 from thermal degradation. Core portion 110 may be made of synthetic materials such as polyester, which may have high tensile strength, but low melting point when compared to natural materials like cotton, which tends to have a high melting point. The denier count for the core portion 110 can be between 5 and 112 denier, and preferably between 20 and 45 denier.

Figure 2:
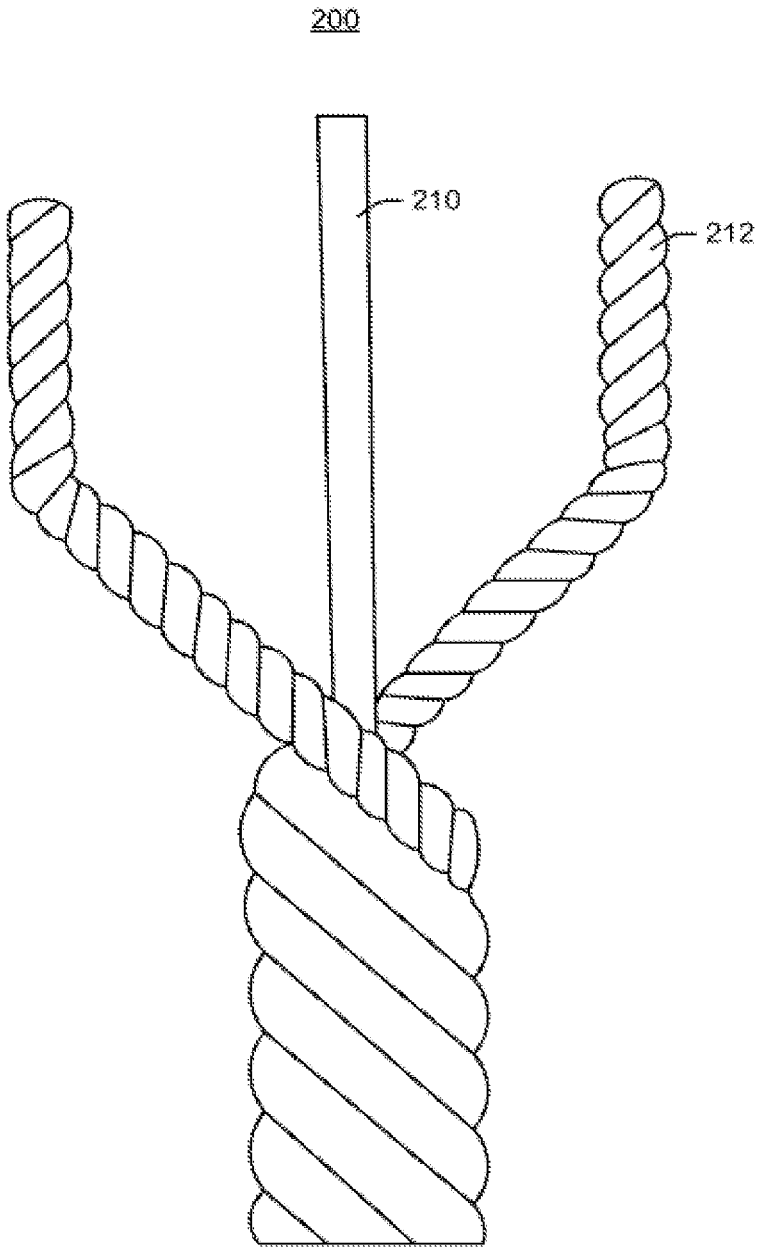
FIG. 2 is a schematic view of a core spun yarn, according to one or more example embodiments.

FIG. 2 is a cross sectional view of a core spun yarn 200, which may be used as warp or weft yarn, either in ground or in pile, in the terry towel 100, as illustrated in FIG. 1, for example. One or more core spun yarns 200 may include a sheath portion 212 and a core portion 210. The sheath portion 212 may include natural yarns, man-made yarns, or blended yarns, although natural fibers such as cotton can also be used. The core portion 210 may include natural yarns, man-made yarns, or blended yarns, although synthetic yarns such as polyester can also be used. The man-made yarns may include filament yarns or spun yarns. The filament yarns may include textured or un-textured yarns. The denier count for the core portion 210 can be between 5 and 112 denier, and preferably between 20 and 45 denier In one example embodiment, the terry towel may include core spun yarns in the range of about 40-60% by weight. In one example embodiment, the core spun yarns may include about 20% by weight polyester in the core portion and about 80% by weight of man-made, natural or blended sheath portion. However, the percentage of polyester in the core spun yarn may range anywhere from 10-40% by weight, and the sheath portion may constitute the remaining 90-60% by weight of the core spun yarn. In one example embodiment, the terry towel may include only polyester yarns in the weft direction. In another example embodiment, the terry towel may include only polyester yarns in warp direction, and the core spun yarns in the weft direction, either alone or in combination with polyester yarns or cotton yarns, which may be alternated with the core spun yarns in any proportion.

Core spun yarns 200 may be produced on a spinning frame in a manner known in the art. The staple fiber roving may be processed through a conventional drafting system on a standard cotton system spinning frame. The polyester filament yarn may be introduced to the middle of the flow of cellulosic fiber stock just behind the front roll of the drafting system. By this means, the polyester filament yarn is not drafted but simply pulled under the nip of the front roll with the staple fibers. Then, since the polyester yarn 210 is a continuous strand, it is held in place between the nip of the front roll and the spindle, and as a result becomes the core or center of the yarn as the staple fibers are twisted around the filament core to form the outer sheath 212 of the yarn 200.

For the staple fiber sheath portion 212 of the core spun yarn 200, either cotton or rayon roving is used at the spinning frame to wrap the polyester filament core 210. In a cotton and polyester core spun yarn, roving of 100 percent combed cotton fibers may be employed. To provide uniform coverage of the polyester filament core, the cotton fibers should have a staple length of at least about 1 1/16 inch, for example.

Figure 3:
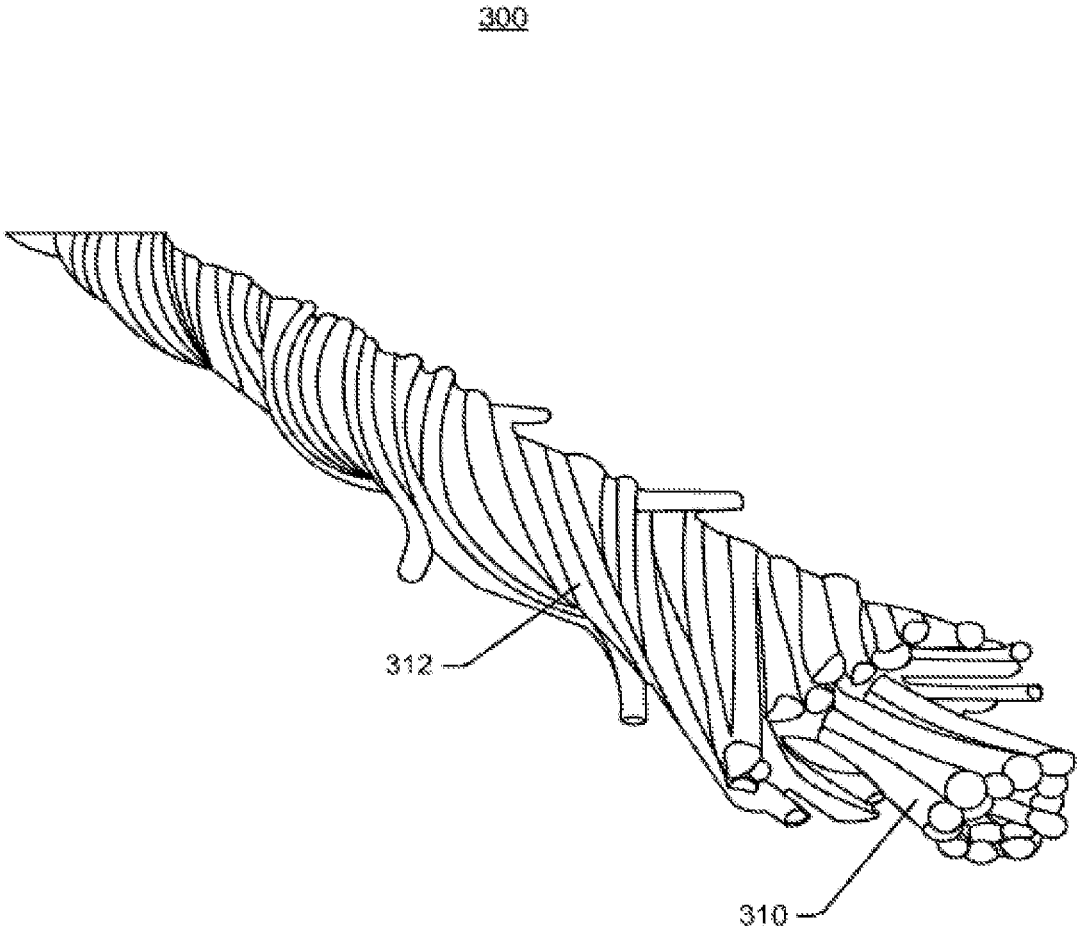
FIG. 3 is a schematic view of a core spun yarn, according to one or more example embodiments.

Turning now to FIG. 3, illustrated is a schematic of a core spun yarn 300, according to one or more example embodiments. The core portion 310 of the core spun yarn 300 may be formed of continuous filament polyester yarn. The denier count for the core portion 310 can be between 5 and 112 denier, and preferably between 20 and 45 denier. The polyester filament core may be a multifilament yarn as opposed to a monofilament yarn, with a sufficiently low denier per filament so as to maintain suppleness and pliability to the yarn and in turn to the woven fabric itself. Multifilament polyester yarn of two to four denier per filament may provide a desirable level of suppleness and pliability to the yarn and fabric. Alternatively or additionally, microdenier filaments having a fiber density of less than 1 denier may be used for providing a super soft hand. It is desirable to have the minimum amount of twist in this polyester filament yarn so as to provide a smooth surface for the even application of the sheath fibers 312.

Figure 4:
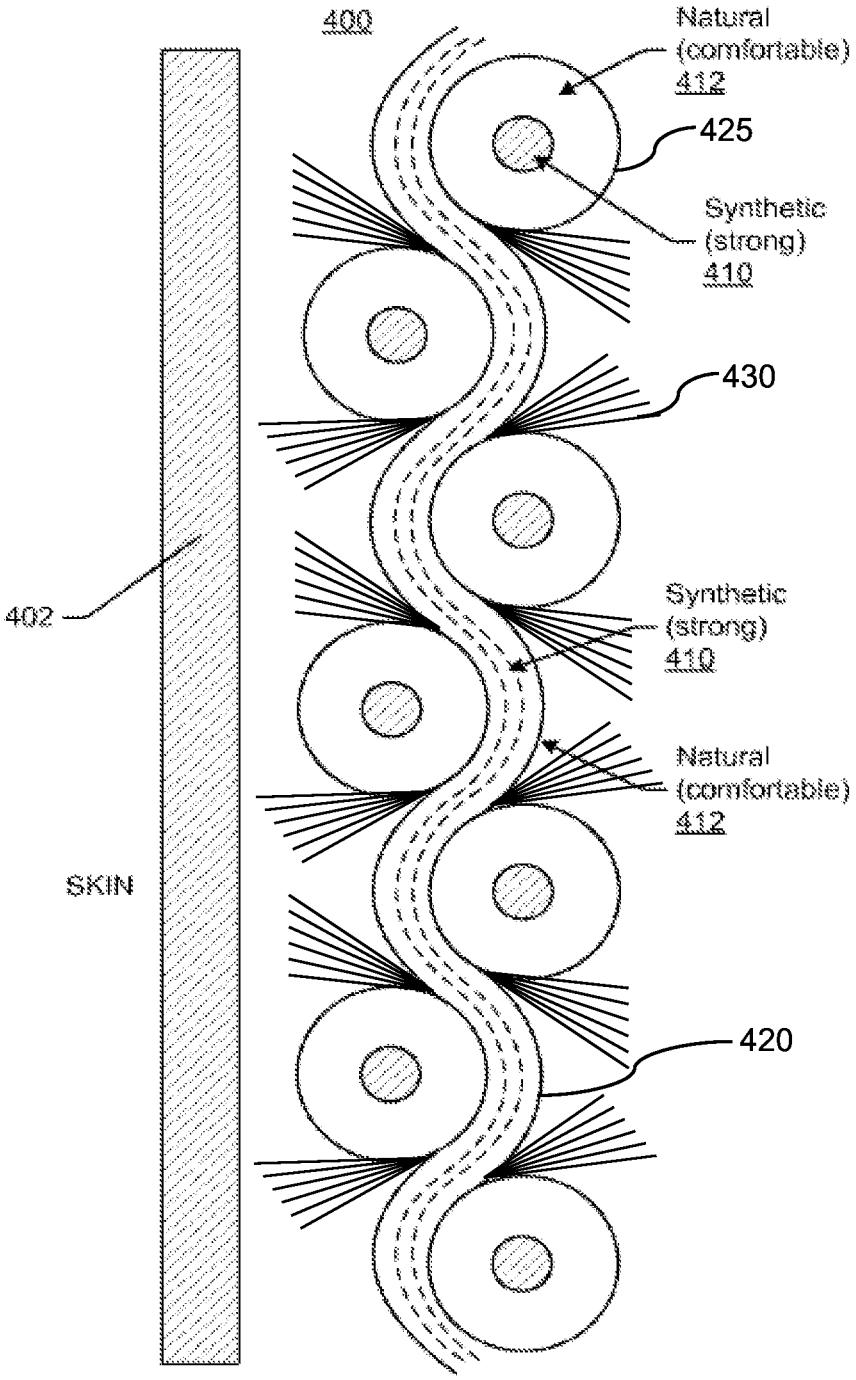
FIG. 4 is an illustrative view of a terry towel or product in accordance with one or more example embodiments.

FIG. 4 illustrates an example use case where terry towel 400, which includes sheared pile yarns 430, may be in contact with the skin 402. In this example, core spun yarns may be used in both the ground warp 420 and ground weft 425 directions in the fabric 400. As illustrated in FIG. 4, the core spun yarns may include a natural, comfortable, sheath portion 412 and a synthetic, strong, portion 410. Although a plain weave is illustrated, the towel 400 may be woven using any weave known to one of skill in the art, including but not limited to twill, satin, or sateen.

Figure 5:
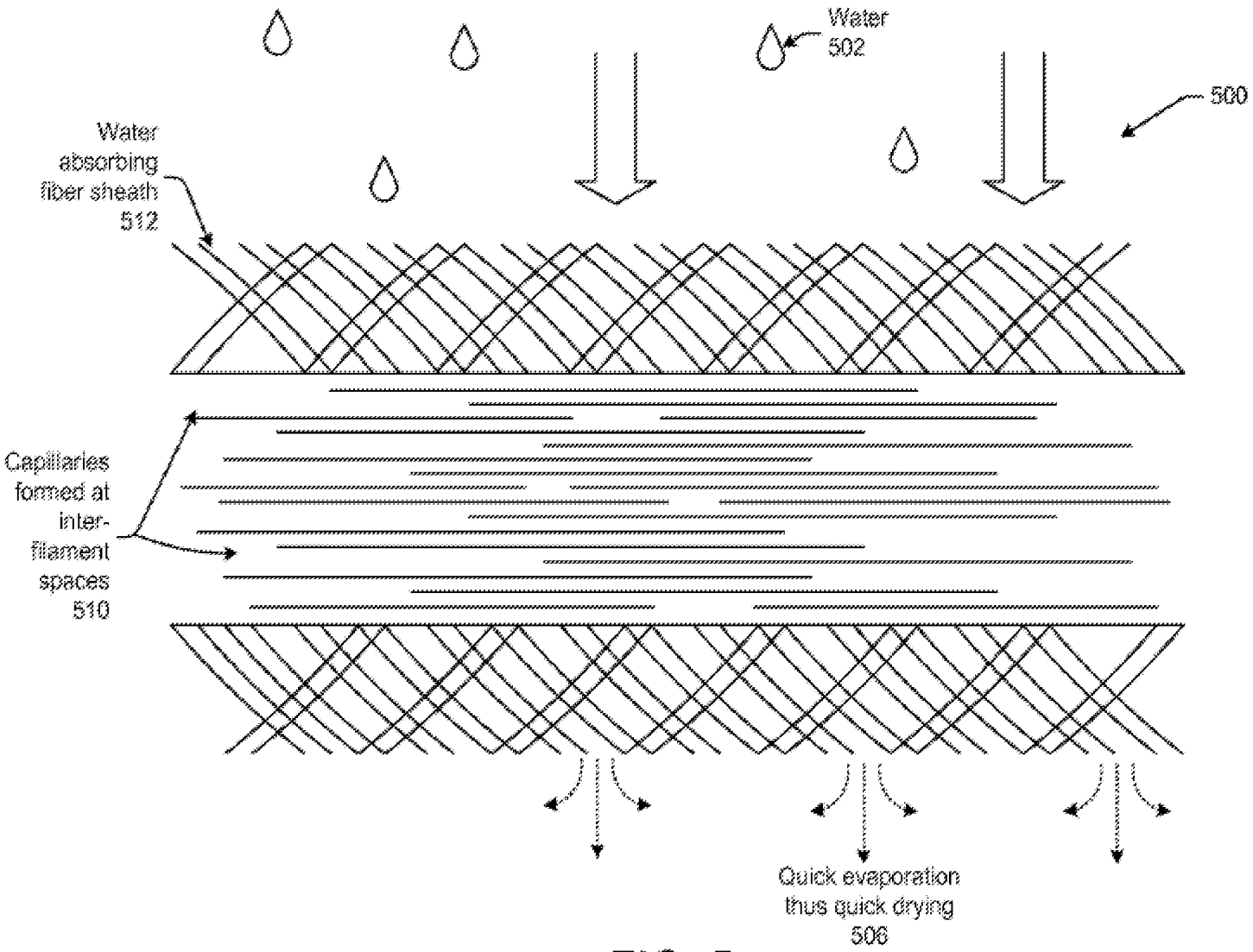
FIG. 5 is an illustrative cross-sectional view of the functioning of a terry towel or product formed in accordance with one or more example embodiments.

FIG. 5 illustrates another example use case where water 502 entering terry towel 500 may quickly evaporate due to the capillaries formed at the inter-filament spaces in the core 510 and the water absorbing sheath 512, thus resulting in a quick drying process. Fabric 500 may include core spun yarns in both the warp and/or weft directions, for example. As illustrated in FIG. 5, the core spun yarns may include a natural, comfortable, sheath portion 512 and a synthetic, strong, portion 510. Quick drying in fabric 500 may result in significant savings in energy costs as the amount of energy used to dry the fabric per unit decreases significantly.

According to one or more example embodiments, the inter-filament spaces in the fibrous structure 200, 300 may be in the form of capillaries that can be occupied by liquid. In general, these capillaries may be much better defined in continuous filament yarns under tension than in spun yarns, and liquid can wick into these structures spontaneously because of capillary pressure. Liquid transport phenomena in capillaries are mainly determined by pore (capillary) size distribution and their connectivity. The complex structural variables included pore sizes, pore size distribution, pore connectivity, and total pore volume. Pore structures in fibrous materials depend significantly on the fiber types and the methods of fiber assembly production. Fiber diameter, length, and shape, as well as fiber alignment may influence the quality of the capillary channels. Polyester filaments are continuous, cylindrical and considerably homogeneous in their sizes. Cotton fibers on the other hand, have highly irregular shapes as well as varying dimensions. These dimensional and shape differences are expected to affect fiber packing and pore quality. Therefore, it can be expected that capillaries structure would be different to some extent in core spun yarns 200, 300 which consist of polyester continuous filaments in core component 210, 310 and cotton fibers in sheath component 212, 312. This deduction may be made from the behavior of a liquid rise in the yarn 200, 300, for example. When yarn 200, 300 comes in contact with the colored liquid, no obvious difference would be observed in the liquid capillary rise height in both components of core 210,310 and sheath 212, 312. This can be attributed to high capillary pressure in the beginning of liquid rise, which includes in the range of 50-60 sec from the initial contact of yarn 200, 300 with liquid. After a while, the difference in the liquid level height in the core 210, 310 and the sheath 212, 312 components can be observed due to the reduction in capillary pressure. In the core component 210, 310, capillaries formed by inter-filament spaces of polyester filaments may have a better quality and continuity than capillaries formed by inter-fiber spaces of cotton fibers 212, 312. This can be due to the continuity of polyester filaments, regular orientation of filaments, and less twist exertion on them than the cotton fibers in the sheath component of the yarn. Therefore, after 50-60 sec from the advancement of liquid into the yarn, the height of the liquid level in core component may be greater than in sheath component. However, after about 90 sec from the contact of the yarn with the colored liquid, differences of liquid level heights in the two components may be clearly perceptible. Although the above example embodiments refer specifically to yarn structures 200, 300, these references are purely exemplary, and a similar or better performance may be exhibited by structures in other example embodiments including 100, 400, and 500.

In order to maintain adequate tensile strength in the finished fabric, however, it may be necessary to use a polyester filament core yarn 210, 310 with a total denier of at least about 5 in the warp, weft or pile. However, to maintain the desired physical and aesthetic characteristics in the fabric, it may be necessary that the total denier not exceed about 112 in any direction. Within this yarn count range, a core spun terry towel can be constructed while maintaining acceptable aesthetic qualities such as softness and suppleness, and acceptable physical standards such as physical strength, weight, and cover. In this regard, the percentage of staple fiber in the core spun warp and/or pile yarns may be kept to a level of at least about 60-90 percent to provide a sufficient amount of staple fiber to adequately cover the filament core.

According to one example embodiment, the terry towel may be woven or knitted. The one or more layers of warp yarns and the one or more layers of weft yarns may include one or more core spun yarns. The warp yarns, the weft yarns, or the core spun yarns may have a yarn density of about 8 to 60 Ne. The warp yarns, the weft yarns, or the core spun yarns may include single or multiple ply yarns. The one or more core spun yarns may include a sheath portion and a core portion. The sheath portion may include natural yarns, man-made yarns, or blended yarns. The core portion may include natural yarns, man-made yarns, or blended yarns. The man made yarns may include filament yarns or core yarns. The filament yarns may include textured or un-textured yarns. The corespun yarn may be preferably combed when used in pile and always carded when used in ground warp or weft direction in combination with open end yarns. One example embodiment is a method for manufacturing a terry towel 100, 400, 500 including providing one or more layers of ground warp yarns and one or more layers of pile warp yarns, and weaving one or more layers of ground weft yarns with the one or more layers of warp yarns and pile warp yarns. At least one of the one or more layers of ground warp yarns, pile warp yarns, and ground weft yarns include one or more core spun yarns. The one or more layers of warp yarns and the one or more layers of weft yarns may include one or more core spun yarns. The warp yarns, the weft yarns, or the core spun yarns may have a yarn density of about 8 to 60 Ne. The warp yarns, the weft yarns, or the core spun yarns may include single or multiple ply yarns. The one or more core spun yarns may include a sheath portion and a core portion. The sheath portion may include natural yarns, man-made yarns, or blended yarns. The core portion may include natural yarns, man-made yarns, or blended yarns. The man-made yarns may include filament yarns or core yarns. The filament yarns may include textured or un-textured yarns. The weight range for the terry towels in the all example embodiments can be approximately in the range of 300-950 GSM or more.

FIG. 6 is a table comparing characteristics of an example core spun yarn, according to one or more example embodiments, with a spun polyester thread. As it may be seen from the table, core spun yarns have significantly higher yarn strength (lbs) when compared to spun polyester yarns. Similarly, terry towels made using the core spun yarns have significantly higher percentage elongation at break, and higher loop strength.

FIG. 7 is table comparing characteristics of an example core spun yarn with an intimate blend yarn, and a 100% cotton yarn, according to one or more example embodiments. The yarns in the fabric tested are around 36 Ne, which are used in the filling direction, and the warp yarns are around 50 Ne 100% cotton yarns in all three cases. As it may be seen from the table, core spun yarns have significantly higher yarn strength (kgf) when compared to an intimate blend or 100% cotton yarn. Similarly, terry towels made using the core spun yarns in the weft direction have significantly higher tensile break strength, higher tensile break elongation as well as tongue tear strength.

FIG. 8 is a table comparing properties of a conventional terry towel with a terry towel with core spun yarns, formed according to one or more example embodiments of the invention. As it can be seen from the table, the tensile strength of the terry towel with corespun yarns is at least twice that of an equivalent towel without the core spun yarns. Similarly, a drying time for drying the terry towel with corespun yarns is at least 30% lower than that of an equivalent towel without the core spun yarns. In some embodiments, the drying rate of the terry towel is at least 15% faster than a conventional towel of the same weight. The tensile strength of the terry towel, which is shown to be around 109, 119 lbf in weft and warp directions, respectively, in the example illustrated in FIG. 9, can be at least 150 lbf or more combined in both directions.

Figure 9:
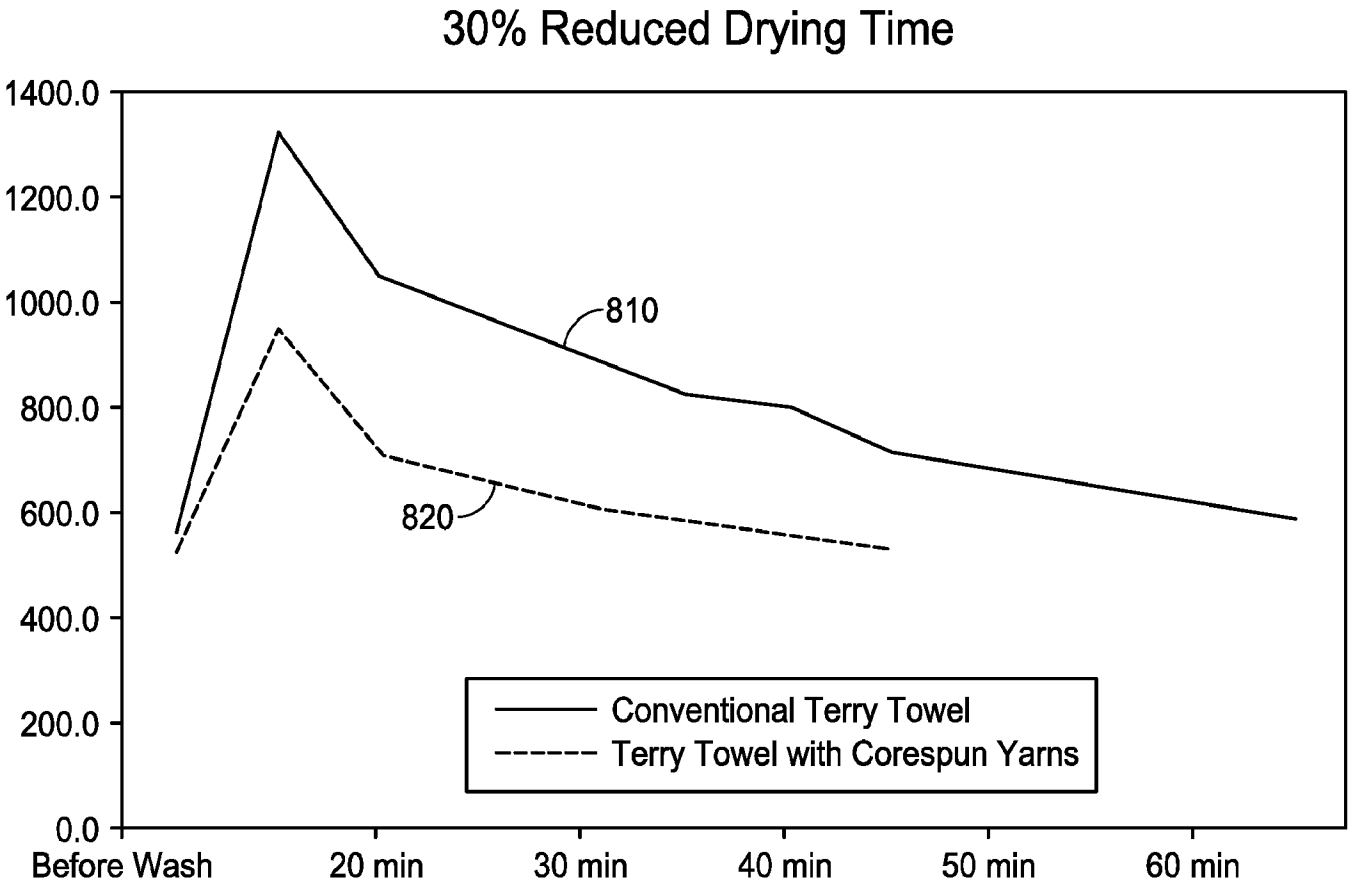
FIG. 9 is a line graph comparing drying rates of a conventional terry towel with a terry towel comprising core spun yarns, according to one or more example embodiments.

FIG. 9 is a line graph comparing drying rates of a conventional terry towel 810 with a terry towel comprising core spun yarns 820, according to one or more example embodiments. The X-axis indicates the weight of the towel in grams and the Y-axis indicates the drying time in minutes. As it can be seen from this graph, the terry towel including core spun yarns 820 has 30% or more reduced drying time when compared with an equivalent towel 810 without the core spun yarns. The drying time, in some examples, is less than 40%, and in some examples, less than 50% that of an equivalent towel without the core spun yarns.

Some features of the above described example embodiments include increasing longevity of the terry towels, improving quality and comfort of the terry towels or products, and reducing operating expense for maintaining the terry towels or products by significantly reducing drying time and energy usage. Reduction in drying time may be a result of, for example, improved wickability and capillary rise in the polyester core of the core spun yarns.

One example embodiment provides terry towels or products having certain physical and aesthetic characteristics which are more luxurious than and superior to the characteristics of the convention terry towels which are presently known. Another example embodiment can provide terry towels or products which more effectively utilize the beneficial properties of the core spun yarns as compared to conventional terry towels or products so as to provide quick dry properties. This property may be specifically important in the hospitality industry as it may result in reduced drying time and reduced energy usage. Another example embodiment provides terry towels or products with high temperature resistance and better dimensional stability because of 100% cotton coverage on the surface of the fabric, which provides insulation to heat. Another example embodiment is a terry towel or product including a plurality of core spun yarns. The terry towel may be woven or knitted. If the terry towel is knitted, then it may be warp or weft knitted.

Another example embodiment provides terry towels or products with 100% cotton coverage on the surface of the towel such that all the fibers that comes in contact with skin are cotton, giving the terry towels or products a great feel and comfort. These and other embodiments can be accomplished by providing a unique terry towels or products construction in which the core spun yarns are located at the ground, and cotton yarns are located at the surface of the towel for improved hand with the cotton sheath of the core spun yarns being on the outside surface and improved physical characteristics with the polyester fibers being located in the core of the yarns to give strength and durability to the fabric.

While there have been shown, described and pointed out, fundamental novel features of the disclosure as applied to the example embodiments, it will be understood that various omissions and substitutions and changes in the form and details of examples illustrated, and in their operation, may be made by those skilled in the art without departing from the spirit of the disclosure. Moreover, it is expressly intended that all combinations of those elements and/or method operations, which perform substantially the same function in substantially the same way to achieve the same results, are within the scope of the disclosure. Moreover, it should be recognized that structures and/or elements and/or method operations shown and/or described in connection with any disclosed form or embodiment of the disclosure may be incorporated in any other disclosed or described or suggested form or embodiment as a general matter of design choice. It is the intention, therefore, to be limited only as indicated by the scope of the claims.

What is claimed is:

1. A terry towel or product comprising:
one or more ground warp yarns;
one or more pile warp yarns; and
one or more ground weft yarns interwoven with the one or more ground warp yarns and the one or more pile warp yarns,
wherein the pile warp yarns comprise one or more core spun yarns, wherein the core spun yarns are in the range of about 40-60% by weight of the terry towel or product,
wherein the one or more core spun yarns comprise a sheath portion and a core portion,
wherein the sheath portion comprises cotton yarn with at least 125 twists per inch,
wherein the core portion comprises man-made yarns, wherein the man-made yarns comprise filament yarns, and wherein the filament yarns comprise texturized yarns,
wherein a tensile strength of the terry towel or product is at least 200 lbf combined in both directions.

2. The terry towel of claim 1, wherein a drying rate of the terry towel is at least 30% faster than that of an equivalent towel without the core spun yarns.

3. The terry towel of claim 1, wherein the ground warp yarns, the pile warp yarns, the ground weft yarns, or the core spun yarns have a yarn count between 8 and 60 Ne.

4. The terry towel of claim 1, wherein the ground warp yarns, the pile warp yarns, the ground weft yarns, or the core spun yarns comprise single or multiple ply yarns.

5. The terry towel of claim 1, wherein the sheath portion comprises natural fibers, man-made fibers, or blended fibers.

6. The terry towel of claim 1, wherein the core to sheath ratio by weight is at least 10:90 or more.

7. The terry towel of claim 1, wherein the sheath provides 100% coverage to the core.

8. The terry towel of claim 1, wherein the terry towel is dyed or bleached.

9. The terry towel of claim 8, wherein the pile warp yarns comprise the core spun yarns, and the core and sheath portion of the core spun yarns are dyed with the same or different color.

10. The terry towel of claim 1, wherein the weight of the terry towel is about 300-950 GSM or more.

11. The terry towel of claim 1, wherein the pile warp yarns are looped or sheared.

12. A terry towel or product comprising:
a plurality of core spun yarns in a pile warp direction, wherein the core spun yarns are in the range of about 40-60% by weight of the terry towel or product,
wherein the core spun yarns comprise a sheath portion and a core portion,
wherein the sheath portion comprises cotton yarn with at least 125 twists per inch,
wherein the core portion comprises man-made yarns,
wherein the man-made yarns comprise filament yarns,
wherein the filament yarns comprise texturized yarns,
wherein a tensile strength of the terry towel or product is at least 200 lbf combined in both directions.

13. The terry towel of claim 12, wherein the terry towel is woven or knitted.

14. The terry towel of claim 13, wherein the terry towel is warp or weft knitted.

15. The terry towel of claim 12, wherein the tensile strength of the terry towel is at least twice that of an equivalent towel without the core spun yarns.

16. The terry towel of claim 12, wherein a drying time for drying the terry towel is at least 30% lower than that of an equivalent towel without the core spun yarns.

17. The terry towel of claim 1, wherein a linear density of the core portion is between 5 and 112 denier.

18. The terry towel of claim 12, wherein a linear density of the core portion is between 5 and 112 denier.

19. A method for manufacturing a terry towel, the method comprising:
providing one or more layers of ground warp yarns and one or more layers of pile warp yarns; and
weaving one or more layers of ground weft yarns with the one or more layers of warp yarns and pile warp yarns such that a weight of the terry towel is in the range of 300-950 GSM or more,
wherein the one or more layers of pile warp yarns comprise core spun yarns,
wherein the core spun yarns comprise a sheath portion and a core portion,
wherein the sheath portion consists of cotton fibers and the core portion consists of polyester filament yarns, wherein a tensile strength of the terry towel is at least 200 lbf combined in both directions.

* * * * *